United States Patent [19]

Chichester

[11] 4,215,622

[45] Aug. 5, 1980

[54] HYDRAULIC CONTROL SYSTEM

[75] Inventor: Willard L. Chichester, Battle Creek, Mich.

[73] Assignee: Clark Equipment Company, Buchanan, Mich.

[21] Appl. No.: 944,828

[22] Filed: Sep. 22, 1978

[51] Int. Cl.[2] ..... F15B 11/16

[52] U.S. Cl. ..... 91/508; 91/530; 414/621; 414/660; 60/484

[58] Field of Search ..... 91/508, 518, 522, 525, 91/530; 414/620, 621, 660, 664, 665, 668; 60/484; 137/355.17

[56] References Cited

U.S. PATENT DOCUMENTS

| | | | |
|---|---|---|---|
| 2,754,018 | 7/1956 | Schroeder | 414/620 |
| 2,870,553 | 1/1959 | Temple | 60/472 X |
| 3,462,028 | 8/1969 | Pi | 187/95 |
| 3,491,905 | 1/1970 | Pi | 414/607 |
| 3,692,198 | 9/1972 | Lake | 414/621 |
| 3,709,252 | 1/1973 | Bishop | 137/355.17 |
| 3,837,515 | 9/1974 | Ohta | 414/666 |
| 3,865,013 | 2/1975 | Mastaj | 91/513 |

*Primary Examiner*—Edgar W. Geoghegan
*Attorney, Agent, or Firm*—J. C. Wiessler

[57] ABSTRACT

A hydraulic control circuit especially for use with multi-function hydraulic devices, such as for industrial lift truck attachments, in which a combination of valve means are adapted to operate two or more hydraulic systems, the valve system being designed such that a minimum number of hydraulic conduits are required to connect the main hydraulic system to the hydraulic devices, as from a lift truck to an attachment supporting carriage on a lift truck upright, and no electric lines are required to be connected to switching devices between the hydraulic devices, such as to solenoid operated valves.

4 Claims, 3 Drawing Figures

HYDRAULIC CONTROL SYSTEM

BACKGROUND OF THE INVENTION

Multi-function hydraulically operated devices which operate at a location which may be movable in one or more directions in relation to the connected hydraulic system requires connecting hydraulic conduits to be movably mounted so that the terminus of hydraulic conduits are continuously connected to the moving device. Examples of such remote devices include multi-function attachments mounted for elevation on telescopic lift truck uprights, devices mounted for operation from the end of telescopic crane or boom mechanisms, and others.

This background and my invention will be described with particular reference to hydraulic control systems for lift truck attachments, but it will be understood that my invention has much wider application as indicated by the title hereof.

As is well-known in the exemplary field of lift trucks, a large variety of attachments have been designed for support by a carriage, conventionally known as a fork carriage, which is elevatable in a telescopic upright for performing various functions for which the attachment may be designed at any selected elevation of the carriage and upright. Such attachments may, for example, be of types known as side shifting clamps, rotating roll clamps, side loaders, and others. Thus, it is required, depending upon the number of functions or operations which the attachment is designed to perform, that a plurality of flexible hydraulic conduits plus, in some instances, electric lines which connect with switching solenoid valves on the lift carriage, for example, be connected from the truck hydraulic system to the attachment by reeving the conduits and lines in the upright, or adjacent to it, for vertical movement with the carriage.

Various means have been devised heretofore for improving the handling and routing of hoses and electric lines in such applications, examples of which are described and claimed in the dual hose reel U.S. Pat. No. 3,709,252, and the internal upright reeving of hydraulic conduits and electric lines as disclosed in U.S. Pat. Nos. 3,462,028 and 3,491,905, all of common assignee. As is well known to persons skilled in the art, disadvantages multiply with the addition of attachment functions which necessitate the addition of more hydraulic conduits and/or electric lines reeved on the upright to travel with the lift carriage. Such disadvantages include interference with operator visibility through the upright, possible rupture or breakage of multiple hydraulic and electric lines, relatively high cost, both initial and in maintenance, and others. One design to minimize the number of such conduits, which in operating some lift truck attachments have heretofore required as many as eight upright reeved hoses, is exemplified by U.S. Pat. No. 3,692,198, also of common assignee. It discloses a structure for reducing the required number of upright reeved conduits to as few as three in relation to a side shifting clamp attachment.

I have devised a hydraulic system for use in such lift truck applications, for example, which is capable of operating and attachment having a plurality of operating functions with as few as two hydraulic conduits reeved in the upright, and with no electric lines reeved therein for connection to carriage mounted solenoid valves as previously used in certain attachment applications.

SUMMARY

A hydraulic control system for operating multi-function remote devices by means of as few as two hydraulic conduits connected from the main hydraulic system to the remote device, the control system including a combination of valve means cooperating to operate under selected conditions any one of a plurality of hydraulically operated functions of the remote device.

This application is directed to a species of the generic invention covered in application Ser. No. 944,829, filed Sept. 22, 1978, in the names of James J. Bauer and me, common assignee.

It is a principal object of the invention to provide a hydraulic system for minimizing the number of hydraulic conduits connecting it to a remote multi-function device.

Other objects and advantages will become apparent from the following description and accompanying drawings.

DETAILED DESCRIPTION

Numeral 10 indicates an industrial lift truck of known configuration having located at the front end thereof a telescopic upright assembly 12 on which is mounted for elevation a side shifting clamp attachment 14 having a pair of hydraulic cylinder actuators 16 and 18 connected to opposed and transversely movable clamp arms 20 and 22. The hydraulic system of the truck is connected to the actuators 16 and 18 in such a manner that clamp arms 20 and 22 may, at the operator's selection, be actuated either toward or away from each other to clamp or unclamp a load located therebetween, or may be acutated in the same direction to shift a clamped load sidewise in either direction transversely of the center line of the truck.

The attachment 14 is merely illustrative of one of many types of multi-function hydraulic attachments for lift trucks or multi-function hydraulic devices for use with other types of vehicles or for other purposes. The attachment 14 is representative of a two-function attachment, viz., for side shifting and clamping actions, whereas, for example, an attachment known as a side shifting rotating clamp is representative of a three-function attachment, viz., side shifting, clamping and rotating. My invention can be implemented to operate such a three-function attachment with as few as two hydraulic conduits and no electric lines reeved on the upright. It will also become apparent as the description proceeds that my invention may be implemented to perform any number of remote hydraulic actuated functions as desired without requiring electric lines or more than two hydraulic conduits to be reeved on an upright, telescopic boom, or whatever structure may be utilized to support hydraulic conduits which connect a hydraulic control system to a remote hydraulic operated device.

Figure 1:
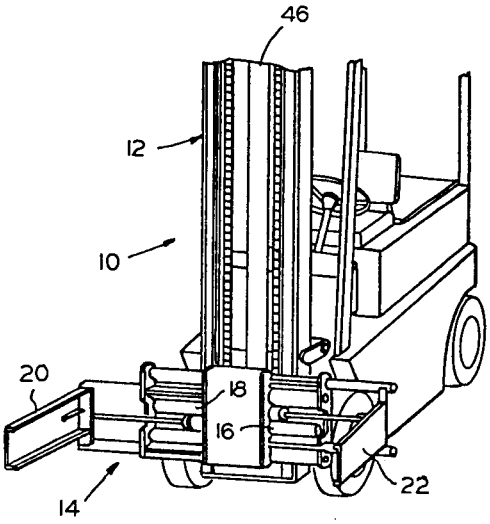
FIG. 1 is a perspective partial view of a lift truck having an exemplary attachment mounted on the upright.
Figure 3:
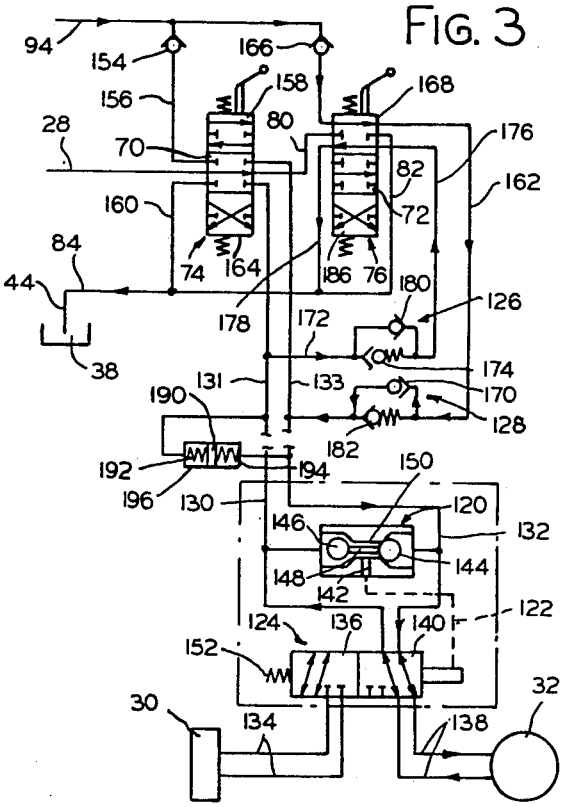
FIG. 3 shows a portion of the FIG. 2 system in a different condition of operation.
Figure 2:
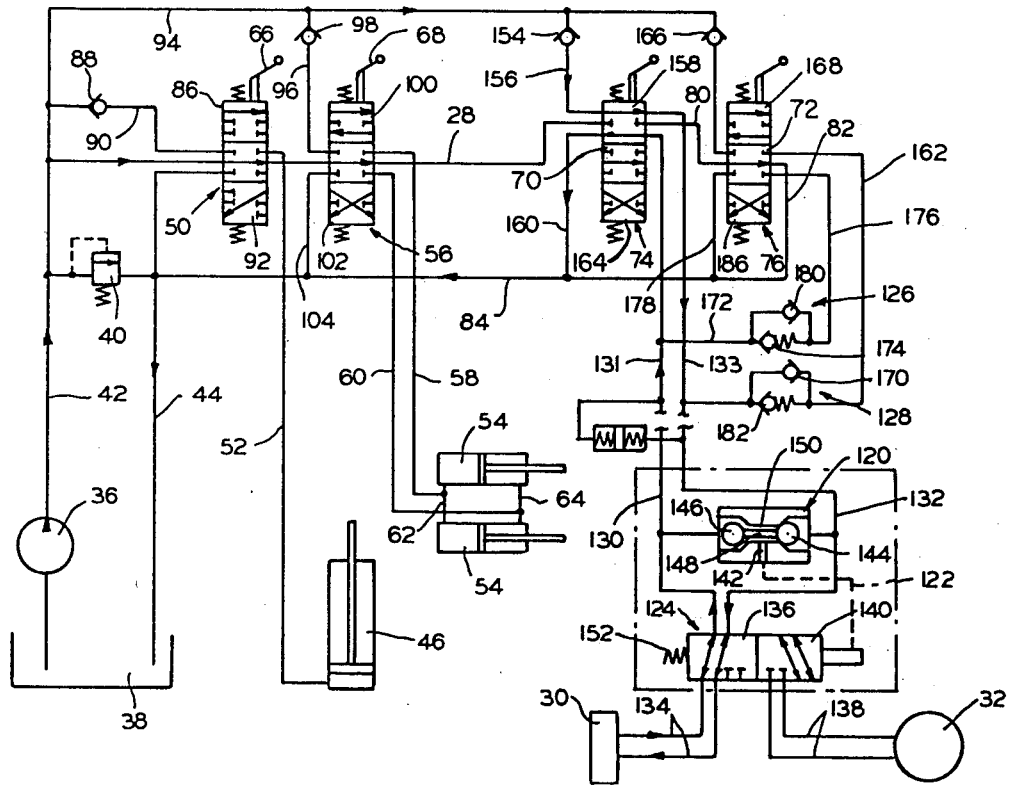
FIG. 2 is a schematic view of the main hydraulic system of a lift truck connected to a multi-function remote device which illustrates a preferred embodiment of my invention, the system being illustrated in combination with a two-function attachment device, the system being illustrated in a control condition to operate one attachment function.

FIGS. 2-3 illustrate two modes of operation in a two-function application, the operating device of which, such as working hydraulic cylinders, a hydraulic rotator, or other device, are represented at numerals 30 and 32.

The main hydraulic system is conventional. It comprises a supply pump 36 connected to a reservoir 38 adapted to recirculate under any over pressure condition through a relief valve 40 by way of conduits 42 and 44. A single-acting lift cylinder assembly 46 for operating the upright 12 and attachment 14 in elevation is connected to a valve 50 by a conduit 52, and a pair of double-acting upright tilt cylinders 54 for tilting upright 12 about the bottom end thereof is connected to a directional control valve 56 by conduits 58, 60 and branch conduits 62, 64. Valves 50 and 56 are operator controlled as by manual levers 66 and 68, the valves being of the known open-center type having neutral or "hold" positions (not shown) wherein the discharge of the pump circulates back to reservoir by way of conduits 42, 28, the center or neutral sections of valves 50 and 56, open center valve sections 70 and 72 of a pair of auxiliary system directional control valves 74 and 76, and conduits 80, 82, 84 and 44. As will be understood, although auxiliary systems valves 74 and 76 are shown in different operating conditions in FIGS. 2 and 3, when both valves are actuated to open center of neutral position, along with main control valves 50 and 56, the circulating fluid flow from pump to reservoir is as stated above.

Valve 50 is actuated down, as shown, to pressurize and elevate lift cylinder 46 and upright 12 by way of a valve section 86 which connects the lift cylinder to the pump via conduits 42, a check valve 88, and conduits 90 and 52. Conversely, valve 50 may be actuated to connect lift cylinder 46 to the reservoir by way of conduits 52 and 44, and valve section 92. Similarly, valve 56 may be actuated to operate cylinders 54 to tilt the upright forwardly by connecting the discharge of the pump to the head ends of the cylinders by way of conduits 42, 94 and 96, a check valve 98, a valve section 100, and conduits 58 and 62. The upright is tilted rearwardly by connecting the pump discharge to the rod ends of the cylinders 54 by the same circuit upstream of the valve, and the valve section 102 and conduits 60 and 64, the opposite ends of cylinders 54 in each instance being connected to reservoir by way of the respective valve section 100 or 102 and conduits 104, 84 and 44.

The hydraulic system as described thus far is conventional, except for auxiliary system selector valves 74 and 76 and the combination thereof with elements to be described, so that in FIG. 3 the conventional portion of the hydraulic system, as applied to lift trucks, is not repeated.

Remote devices 30 and 32 are adapted to be operated in selected sequence and direction by the operation of a shuttle valve 120 controlling a pressure signal through a pilot line 122 to an auxiliary system control valve 124, the operator directional and remote system selector valves 74 and 76 and pairs of check valve sets 126 and 128 being located with valves 74 and 76 in the lift truck application exemplified in the operator's compartment upstream of and remote from attachment or fork carriage mounted valves 120 and 124.

The structure and operation of valves 120 and 124 will now be described. Pilot operated valve 124 is located in the control circuit for working devices 30 and 32 between supply conduits 130, 132 and a first pair of conduits 134 which connect a valve section 136 to device 30 under certain conditions, and a second pair of conduits 138 which are adapted under other conditions to connect device 32 to conduits 130 and 132 by way of a valve section 140. Shuttle valve 120 is connected between conduits 130 and 132; it has a center pilot port 142 which is connected to valve 124 by pilot line 122 to actuate valve 124 under certain conditions so as to connect or disconnect, as the case may be, either of working devices 30 and 32. The shuttle valve includes a pair of spaced and opposed ball check valves 144 and 146, one of which has a stem 148 secured thereto which projects through a connecting channel 150 so that depending upon which of conduits 130 or 132 contains the higher pressure fluid is determined which of the ball checks is actuated to seat which in turn causes the opposite ball check to unseat by the action of stem 148. Fluid pressure in the low pressure conduit flows through the unseated ball check into a pilot operating chamber of valve 124 by way of channel 150, port 142 and pilot conduit 122, Valve 124 being normally maintained in the position shown in FIG 2. by a spring 152.

If it is desired to operate device 30 in one direction valve 74 is actuated downwardly while valve 76 is maintained in an open-center position, as shown in FIG. 2, which deadports all valve sections of valve 76 and connects valve 74 to pump discharge pressure and to the selected working side of device 30 by way of check valve 154, a conduit 156, valve section 158 of valve 74, conduits 133, 132 and 134, and valve section 136 of valve 124, return flow from device 30 to the reservoir being by way of valve section 136 of valve 124, conduits 130 and 131, valve section 158 of valve 74, and conduits 160, 84 and 44. Reservior pressure fluid is communicated from conduit 130 through shuttle valve 120 and pilot line 22 so that control valve 124 is maintained in position by spring 152 to operate device 30, while pump discharge fluid in conduit 133 deadports at the center valve section of valve 76 by way of check valve set 128 and conduit 162 and check valve set 126 is connected to conduit 131, it being prevented from entry to conduit 176 by check valve set 126. Thus, device 30 is operated in one direction as a result of the said actuation of valve 74, the check valves of both valve sets 126 and 128 remaining seated during such operation (except for any opening of check valve 174 to pressurize conduit 176).

A reversal of operation of device 30 is effected, of course, by actuating valve 74 to its opposite operating valve section 164 which reverses the flow in the above circuit to device 30 and actuates the shuttle valve 120 to the right, thereby effecting a reversal of operation of device 30.

If the operator elects to operate device 32, control valve 74 is returned to a neutral or open-center position and directional control valve 76 is actuated to operate device 32 in one direction or the other. As shown in FIG. 3 valve 76 is actuated down to connect pump discharge conduit 94 to one side of device 32 by way of a check valve 166, valve section 168 of valve 76, conduit 162, check valve 170 of valve set 128, conduits 133 and 132, valve section 140 of valve 124 and conduit 138. The return flow from device 32 is by way of valve section 140 of valve 124, conduits 130, 131, and 172, check valve 174 of valve set 126, conduits 176, 178, 84 and 44, and valve section 168 of valve 76, control valve 74 being deadported at all sections as shown.

In the check valve sets 126 and 128 checks 170 and 180 are illustrated as standard charging check valves which function to assure pressure in the respective conduits 162 and 176 when said conduits conduct system pressure fluid to devices 30 and 32, and to direct control pressure flow through system pressure control checks 174 and 182 as will appear below. Control pressure checks 174 and 182 are shown spring pressure loaded and each represents an assumed 200 psi pressure loading for illustrative purposes. Thus, as assumed, with the various valves positioned as in FIG. 3 the flow to device 32 occurs as above described with the 200 psi pressure generated in conduits 130, 131 and 172 by check valve 174 which actuates control valve 124 to activate section 140 thereof by way of shuttle valve 120 and pilot line 122. To reverse the operation of device 32 valve 76 is actuated upwardly to engage section 186 thereof which reverses the direction of flow in the auxiliary system such that the shuttle valve 120 is actuated to the right and the exhaust pressure of device 32 is controlled at the assumed 200 psi by check valve 182 holding control valve 124 in its FIG. 3 illustrated position.

The basic circuit structure described above is preferred in respect of locating shuttle valve 120 on the attachment or other remote device so as to require two hydraulic conduits only, viz., 130 and 132, to be reeved on the upright, although the same functional result would be achieved by locating the shuttle valve on the truck which would then necessitate the additional reeving on the upright of pilot conduit 122. The use of three such conduits is clearly within the scope of the invention, although, of course, the use of two conduits only is preferred as described in respect of the circuit as shown. It is also again noted that in none of the embodiments are electric lines required connecting the main hydraulic system to the auxiliary or remote device control for the purpose of shifting solenoid valves, or the like, to shift operation from one remote device to another. Connecting hydraulic lines only are required.

In FIGS. 2 and 3 it will be noted that a free floating piston head 190 is mounted in a small hydraulic cylinder 196 between a pair of equal and opposed springs 192 and 194, the cylinder being connected at its opposite ends to lines 130 and 132. Normally in operation the compensator piston head 190 is inoperative to perform any function and moves to one end of the cylinder or the other depending upon which of the lines 130 or 132 is pressurized.

In a particular condition of operation, however, which may occur from time to time at one or another of hydraulic actuators 30 and 32, the compensator piston 190 is effective to provide that very small volume of pilot pressure fluid required to actuate valve 124 by way of pilot line 122. That is, under usual conditions of operation a pilot pressure impulse to actuate valve 124 is provided via the shuttle valve by an extremely small movement of the hydraulic actuator 30 or 32 at the time of venting of the one side thereof to reservoir pressure. However, in the event an actuator piston or other actuator is bottomed out at the extreme end of its stroke at one end or the other of its cylinder, for example, it cannot be actuated even the minute amount required to provide pilot pressure at valve 124. Under these conditions, and only under such conditions, compensator piston 190 provides the impulse to pilot line 122 to actuate valve 124 during a selected change in direction at control valve 74 or 76. Of course, piston 190 is always available for that function, but is only required to perform the function in the event that an actuator piston or other hydraulic actuator is bottomed out.

It is to be emphasized that regardless of the number of remote auxiliary system devices for which the auxiliary system selector and check valve sets are designed, it is possible to limit the number of conduits which connect the main hydraulic system to the remote control valve controlling three or even more remote working devices to a few as two connecting hydraulic conduits. This can be accomplished by adding directional control or auxiliary system selector valves the same as valves 74 and 76 and by adding a check valve circuit including check valve sets similar to 126 and 128 for each additional directional control valve, all plumbed by conduit means to actuate and additionally multi-ported auxiliary system control valve 124 which, for a three device system, would include an additional valve section such as 136, 140 to service an additional auxiliary system device such as 30 or 32. In any such latter system according to the embodiment disclosed, when applied, for example, to remote devices located in an attachment on the upright of a lift truck as previously described, the only pair of hydraulic conduits required to be reeved in the upright are the conduits 130 and 132 between the shuttle valve and the check valve sets 126 and 128, the check valve sets being mounted on the truck in the preferred embodiment.

Although there is described and illustrated only one embodiment of my invention, it will be understood by those skilled in the art that modifications may be made in the structure, form and relative arrangement of parts without necessarily departing from the spirit and scope of the invention. Accordingly, it should be understood that I intend to cover by the appended claims all such modifications in both structure and application which fall within the scope of the invention.

I claim:

1. In a hydraulic system, first and second hydraulic motor means, selector valve means movable to first and second positions in response to first and second respective control pressures present in the low pressure side of the system for operatively connecting said valve means in said first position to said first hydraulic motor means and in said second position to said second hydraulic motor means, and operator valve means adapted to select the operation of said first or second motor means and to establish said first or second control pressure, said operator valve means being remote from said motor means and selector valve means and connected across the remote spacing thereof by two hydraulic conduits only, the operator valve means including a pair of independently operable directional control valves for controlling the respective direction of operation of said first and second hydraulic motor means.

2. A hydraulic system as claimed in claim 1 wherein check valve means are associated with said two conduits for establishing said first or second control pressure in response to the operation of said first or second directional control valve.

3. A hydraulic system as claimed in claim 1 wherein a shuttle valve is connected operatively between said two conduits responsive to the high pressure conduit as selected by the first or second direction control valve for communicating the low pressure conduit to actuate said selector valve means.

4. A hydraulic system as claimed in claim 2 wherein said check valve means comprise first and second check valves responsive to the pressure in different ones of said two conduits but always only on the low pressure side of the system in order to establish one of said first or second control pressures in both forward and reverse operation of said motor means.

* * * * *